US012560043B2

(12) United States Patent
Nguyen et al.

(10) Patent No.: US 12,560,043 B2
(45) Date of Patent: Feb. 24, 2026

(54) WELLHEAD GRIPPING ASSEMBLY INSTALLATION TECHNIQUE AND SETTING TOOL

(71) Applicant: CAMERON INTERNATIONAL CORPORATION, Houston, TX (US)

(72) Inventors: Dennis P. Nguyen, Houston, TX (US); Stuart Robinson, Ploiesti (RO); Brandon B. Shirley, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 19/107,580

(22) PCT Filed: Sep. 25, 2023

(86) PCT No.: PCT/US2023/033597

§ 371 (c)(1),
(2) Date: Feb. 28, 2025

(87) PCT Pub. No.: WO2024/072731

PCT Pub. Date: Apr. 4, 2024

(65) Prior Publication Data

US 2026/0002423 A1 Jan. 1, 2026

Related U.S. Application Data

(60) Provisional application No. 63/434,682, filed on Dec. 22, 2022, provisional application No. 63/410,093, filed on Sep. 26, 2022.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 3,994,517 A * 11/1976 Carmichael ..... E21B 33/0422 285/123.7
4,407,514 A * 10/1983 Hausler ..... E21B 33/129 277/621

(Continued)

FOREIGN PATENT DOCUMENTS

WO 2022177899 A1 8/2022

OTHER PUBLICATIONS

International Search Report and Written Opinion of International Patent Application No. PCT/US2023/033597 dated on Jan. 11, 2024, 09 pages.

*Primary Examiner* — Steven A Macdonald
(74) *Attorney, Agent, or Firm* — Kyle R. Miiller

(57) ABSTRACT

A wellhead clamp for elastically deforming a wellhead housing to grip a wellhead hanger is provided. In one embodiment, a wellhead clamp (50) includes a first energizing ring (56), a second energizing ring (54), compression segments (52) positioned between the two energizing rings, and segment retainers (80) fastened to the compression segments and to the energizing rings. The segment retainers retain the compression segments between the energizing rings and hold the energizing rings apart in an expanded arrangement that allows the compression segments to be in a radially retracted position that facilitates running of the wellhead clamp onto the wellhead housing (20). A setting tool (110) can be used to apply a setting load to the wellhead clamp. The setting tool can be a hydraulic setting tool with pistons (132, 178), which may be bidirectional pistons in (Continued)

some instances, to apply the setting load. Additional systems, devices, and methods are also disclosed.

20 Claims, 15 Drawing Sheets

(56) References Cited

U.S. PATENT DOCUMENTS

| | | | | |
|---|---|---|---|---|
| 6,129,149 | A | 10/2000 | Beall | |
| 11,608,701 | B1 * | 3/2023 | Allen | E21B 33/06 |
| 11,719,073 | B2 * | 8/2023 | Shirley | E21B 23/02 166/88.1 |
| 12,006,792 | B2 * | 6/2024 | Shirley | E21B 21/08 |
| 2005/0146137 | A1 | 7/2005 | Davidson et al. | |
| 2014/0152005 | A1 | 6/2014 | Liew | |
| 2022/0034184 | A1 | 2/2022 | Gonzalez et al. | |
| 2022/0034189 | A1 | 2/2022 | Hendrie et al. | |
| 2022/0034196 | A1 * | 2/2022 | Shirley | E21B 33/0422 |
| 2022/0259938 | A1 | 8/2022 | Guidry et al. | |
| 2023/0304381 | A1 * | 9/2023 | Shirley | E21B 21/08 |

* cited by examiner

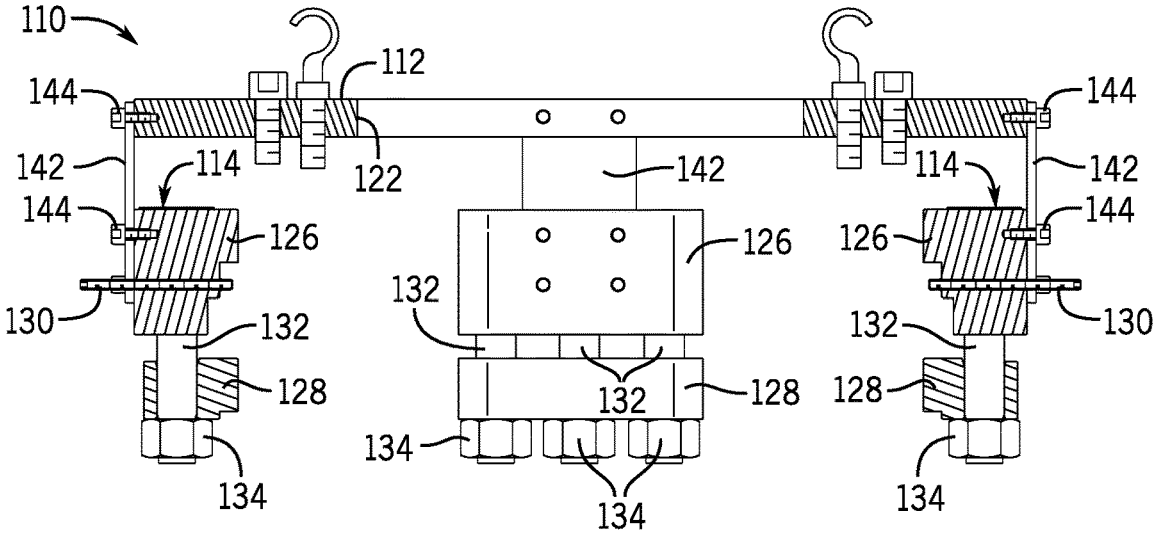
FIG. 10
FIG. 11
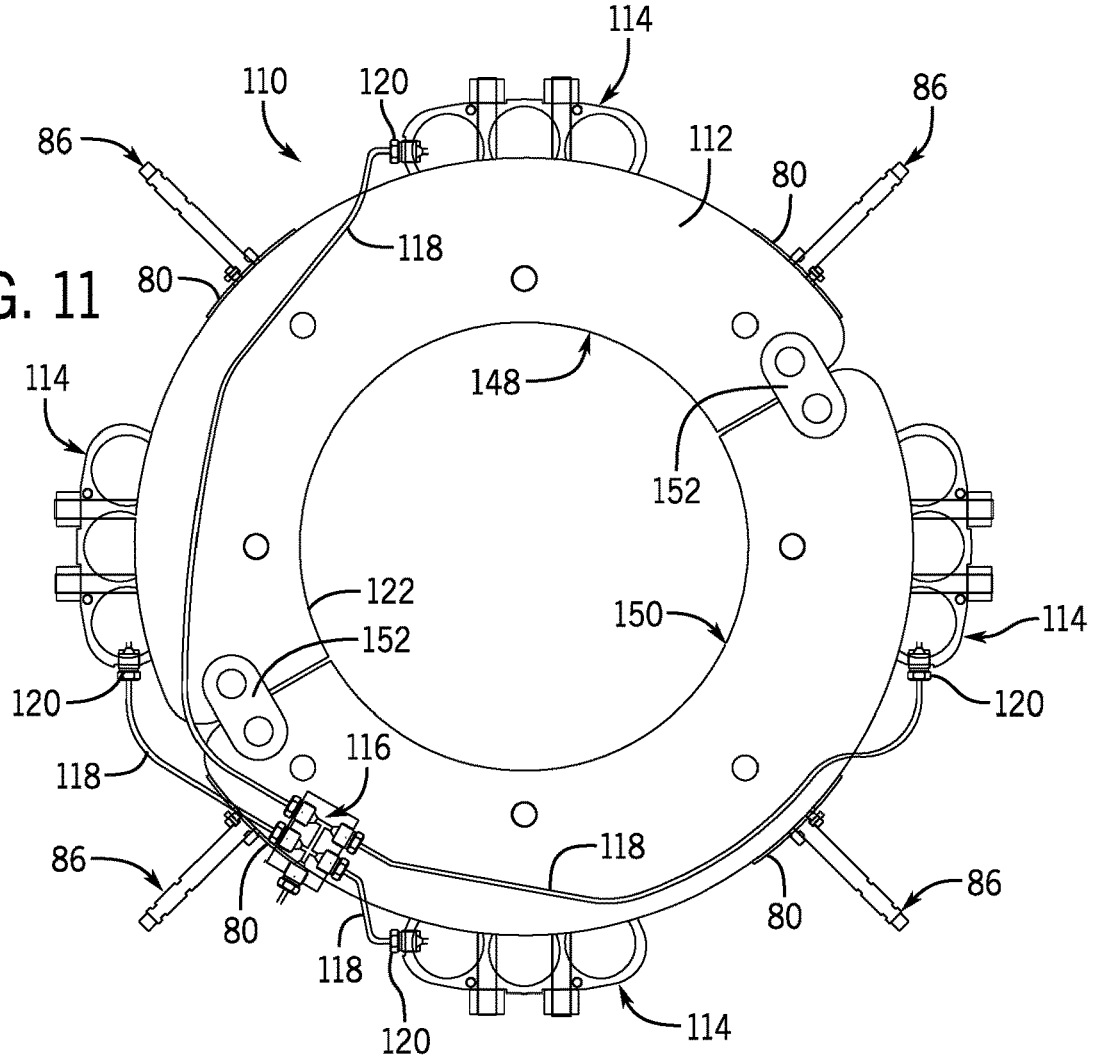

WELLHEAD GRIPPING ASSEMBLY INSTALLATION TECHNIQUE AND SETTING TOOL

CROSS-REFERENCES TO RELATED APPLICATIONS

This application is the National Stage Entry of International Application No. PCT/US2023/033597, filed Sep. 25, 2023, which claims priority to and benefit of U.S. Provisional Patent Application No. 63/410,093 filed Sep. 26, 2022, and claims priority to and benefit of U.S. Provisional Patent Application No. 63/434,682 filed Dec. 22, 2022, both of which are hereby incorporated by reference herein in their entireties for all purposes.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various housings, casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to a wellhead clamp for elastically deforming a wellhead housing to securely grip a wellhead hanger within a bore of the wellhead housing. In one embodiment, a wellhead clamp includes a first energizing ring, a second energizing ring, compression segments positioned between the two energizing rings, and segment retainers fastened to the compression segments and to the energizing rings. The segment retainers retain the compression segments between the energizing rings and hold the energizing rings apart in an expanded arrangement that allows the compression segments to be in a radially retracted position that facilitates running of the wellhead clamp onto the wellhead housing. A combination running tool may be used in some instances to run the wellhead clamp onto a wellhead housing and set the wellhead clamp in a single trip. A setting tool can be used to apply a setting load to the wellhead clamp. The setting tool can be a hydraulic setting tool with pistons, which may be bidirectional pistons in some instances, to apply the setting load to the wellhead clamp.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein:

FIG. 10 is a section view of a running tool like that of FIG. 9 but with the hydraulic clamp tools connected to the support body with braces in accordance with one embodiment;

FIG. 11 is a top plan view of a running tool like that of FIG. 8 but in which the support has multiple segments connected with latches in accordance with one embodiment;

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
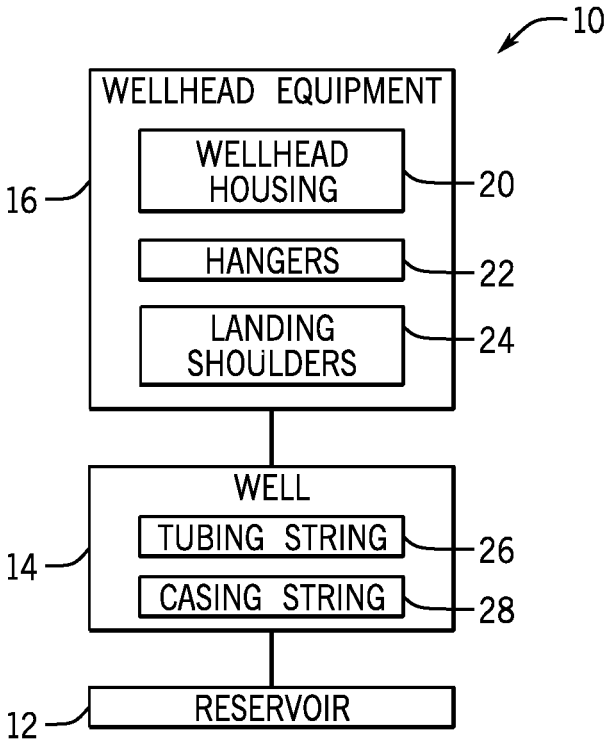
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14, such as an onshore well. Wellhead equipment 16 is installed on the well 14. As depicted, the wellhead equipment 16 includes a wellhead housing 20 and wellhead hangers 22. The wellhead housing 20 may include one or more casing heads and a tubing head in some instances. In some cases, the wellhead housing 20 includes a single-piece body designed to receive multiple hangers 22, such as a casing hanger and a tubing hanger. The hangers 22 can be mandrel-style hangers or slip-style hangers. The components of the wellhead equipment 16 can differ between applications, and could include a variety of casing heads, tubing heads, spools, housings, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the wellhead housing 20). These landing shoulders 24 can be integral parts of the wellhead housing 20 or can be provided by other components, such as sealing assemblies or landing rings disposed in the wellhead housing 20. In some instances, a wellhead hanger 22 can be secured within a hollow wellhead body using a gripping device without landing the wellhead hanger 22 on a landing shoulder 24. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well.

Certain embodiments of the present disclosure generally relate to a combination running tool for installing a gripping device on a wellhead. In some embodiments, the gripping device is a clamp that includes energizing rings and compression segments. In at least one embodiment, the gripping device is installed on a wellhead and provides an inward compression force (via the compression segments) that elastically deforms the wellhead housing into tight, gripping engagement with a wellhead hanger or other body received within the wellhead housing. The combination running tool can be used to deliver the gripping device and one or more clamp tools to a desired axial location along a wellhead and to facilitate actuation of the gripping device to secure the wellhead hanger (or another received body) within the wellhead housing. In at least some instances, the gripping device and one or more clamp tools may be delivered to a desired axial location and the gripping device can be actuated during a single trip of the combination running tool, rather than using multiple trips for completing different aspects of delivery of the components and actuation of the gripping device.

Figure 2:
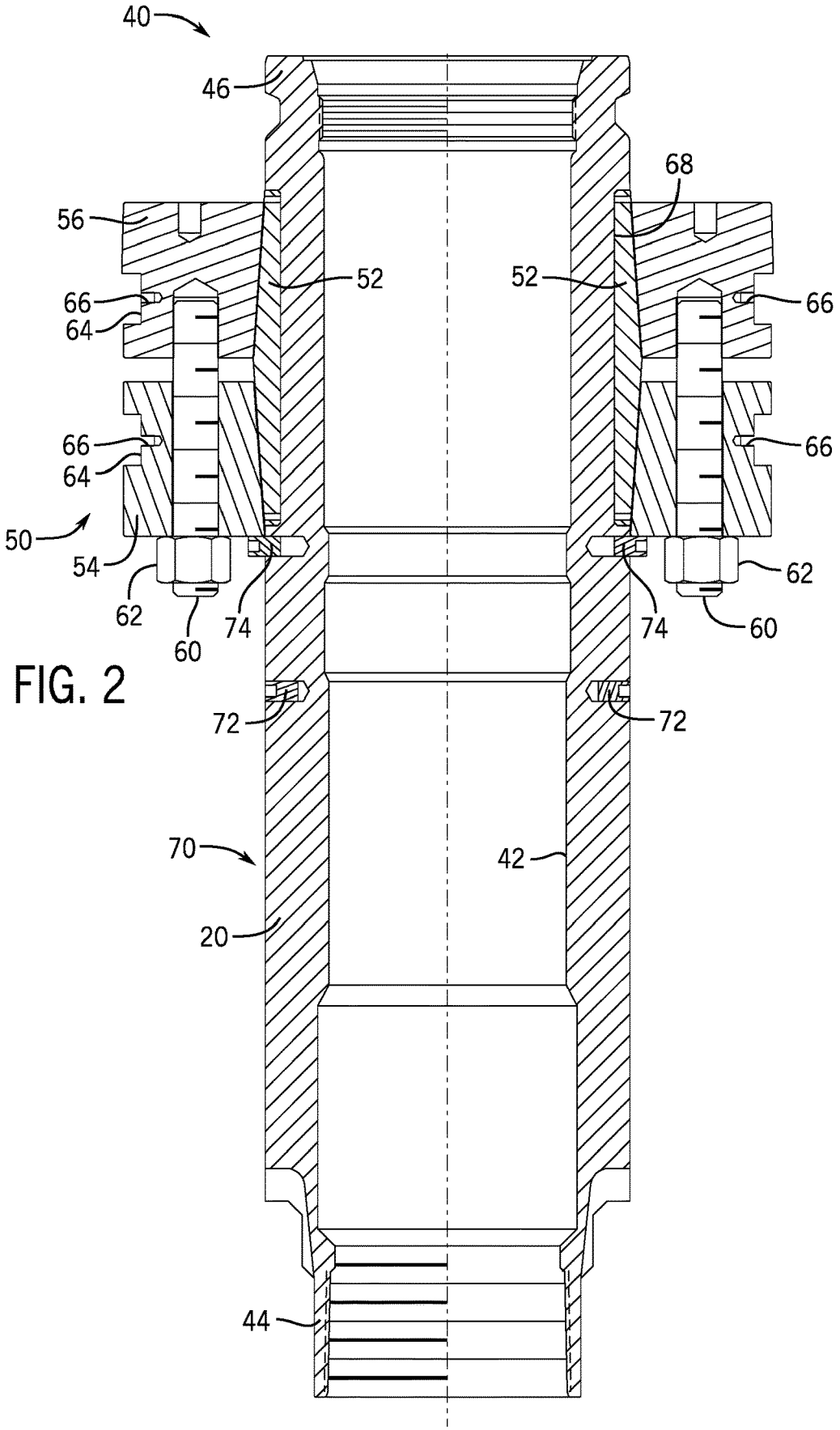
FIG. 2 is a section view of a wellhead assembly having a wellhead clamp installed on a wellhead housing in accordance with one embodiment.

By way of example, a wellhead assembly 40 is depicted in FIG. 2 as having a hollow wellhead housing 20 with an axial bore 42 extending from a lower end 44 of the housing 20 to an upper end 46. The wellhead assembly 40 of FIG. 2 includes a gripping device 50, which may also be referred to as a wellhead clamp 50, positioned to elastically deform the wellhead housing to securely grip a wellhead hanger within the bore 42. The depicted wellhead clamp 50 includes a compression ring with compression segments 52, a lower energizing ring 54, and an upper energizing ring 56. These components can have any suitable form. In some embodiments, the compression ring is a segmented annular ring formed of four compression segments 52 arranged circumferentially about the wellhead housing 20, although some other number of compression segments 52 could be used. Separation of adjacent segments 52 facilitates contraction of the compression ring about the wellhead housing 20. The compression ring could be provided as an annular ring with one split in its circumference (i.e., a C-ring) in other instances.

Through the tapered engagement of the compression segments 52 with the energizing rings 54 and 56, drawing the energizing rings 54 and 56 toward one another applies a radially inward compression force to the compression ring segments 52, which contract and elastically deform the wellhead housing 20 to grip a wellhead hanger positioned along the bore 42 inside the clamp 50. Although a wellhead hanger is not depicted inside the clamp 50 in FIG. 2, such a wellhead hanger could be installed and gripped inside the clamp 50 at some other time. The energizing rings 54 and 56 can be connected to one another in any suitable manner, such as with studs 60 and nuts 62. It will be appreciated that the clamp 50 can include any suitable number of studs 60 and nuts 62, such as twelve or sixteen pairs of circumferentially arrayed studs 60 and nuts 62. In some instances, the energizing rings 54 and 56 include tool recesses 64 (e.g., annular grooves) to facilitate use of a hydraulic tool for drawing the rings 54 and 56 together to actuate the clamp 50. As discussed further below, holes 66 facilitate fastening of other components to the energizing rings 54 and 56.

The compression ring segments 52 may be positioned in recessed portion 68 of the outer surface of the wellhead housing 20 to facilitate elastic deformation of the wellhead housing 20 when the clamp 50 is actuated. As shown in FIG. 2, the clamp 50 is positioned near the top of the wellhead housing 20 to elastically deform the wellhead housing 20 and grip a hanger of a tubular string, such as a tubing string. But the wellhead housing 20 could also or instead have a clamp 50 positioned at a different location along the housing 20, such as at location 70, for gripping a different tubular string hanger, such as a casing string hanger.

In at least some embodiments, including that depicted in FIG. 2, landing screws 72 and 74 are installed in an exterior of the wellhead housing 20. As described in further detail below, the landing screws 72 and 74 may be used to facilitate installation of the clamp 50. Although two landing screws 72 and two landing screws 74 are shown in FIG. 2, any suitable numbers of landing screws 72 and 74 may be used. In some embodiments, for instance, four or six lower landing screws 72 may be arranged circumferentially about the wellhead housing 20 at a first axial location and four or six upper landing screws 74 may be arranged circumferentially about the wellhead housing 20 at a second axial location. In at least some embodiments, these landing screws 72 and 74 are threaded into holes in the wellhead housing 20 and may be selectively backed out from the holes to protrude radially outward from the exterior of the wellhead housing 20 for use as a landing surface for the clamp 50 during installation.

Figure 4:
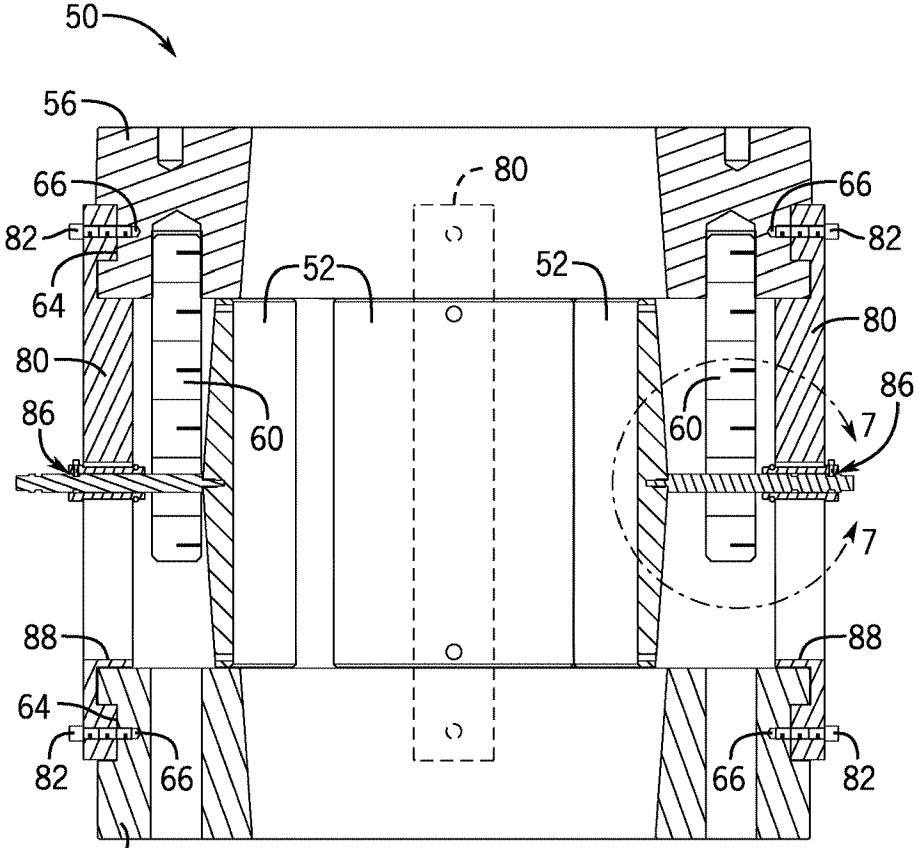
FIG. 4 is a cross-section of the wellhead clamp of FIGS. 2 and 3 and shows segment retainers connected to the compression segments and the energizing rings in accordance with one embodiment.
Figure 3:
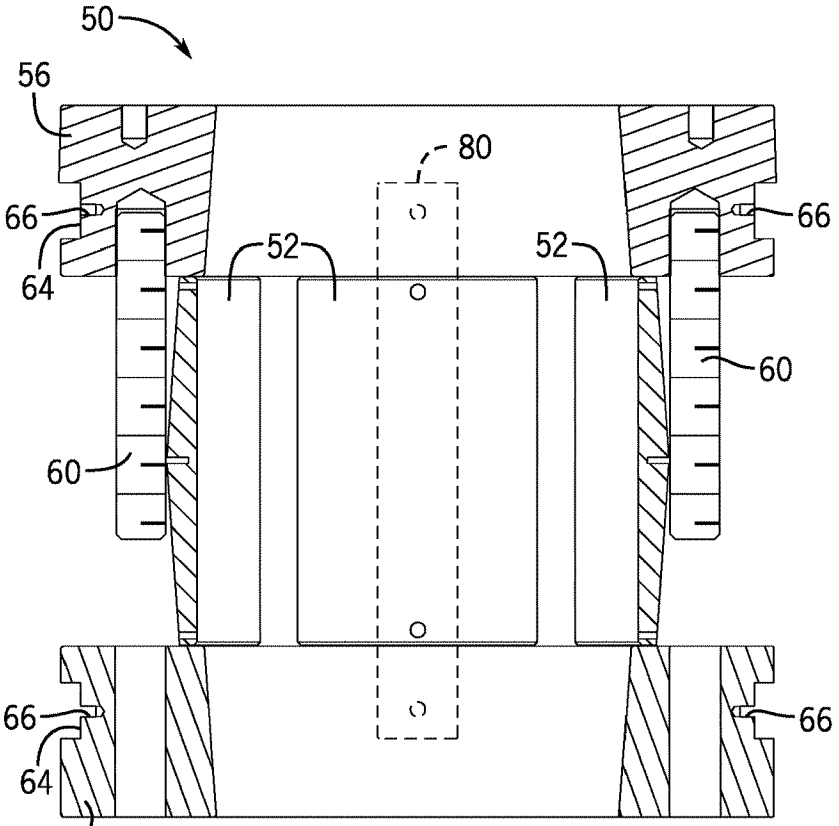
FIG. 3 is a cross-section of the wellhead clamp of FIG. 2 shown prior to installation, with the wellhead clamp including compression segments held in a radially retracted position between two energizing rings, in accordance with one embodiment.
Figure 5:
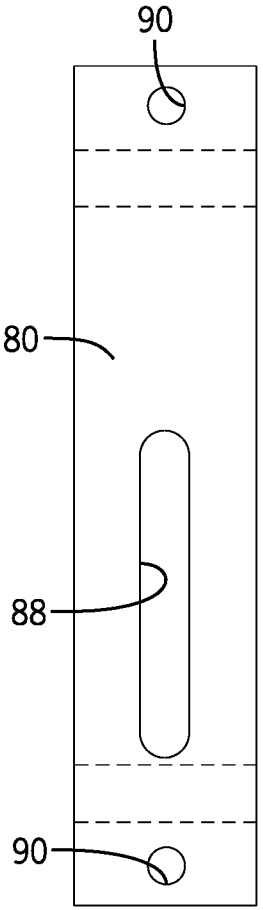
FIG. 5 is a front elevational view of a segment retainer of FIG. 4 in accordance with one embodiment.

The clamp 50 is depicted in FIGS. 3 and 4 in an expanded arrangement for running the clamp 50 onto the wellhead housing 20 in accordance with certain embodiments. In FIG. 3, the energizing rings 54 and 56 are spaced apart from one another with the compression segments 52 positioned between the energizing ring 54 and the energizing ring 56. The compression segments 52 in FIG. 3 are depicted in a radially retracted position in which the compression segments 52 do not protrude radially inward beyond the inner surfaces of the energizing rings 54 and 56. This radially retracted position facilitates running of the clamp 50 onto the wellhead housing 20. In some embodiments, segment retainers 80 are fastened to the compression segments 52 and the energizing rings 54 and 56. As shown in FIG. 4, for instance, a segment retainer 80 may be fastened to the energizing rings 54 and 56 with fasteners 82 and to the compression segments 52 with a retainer screw (or other fastener) 86. Each segment retainer 80 can include a slot 88 for receiving a retainer screw 86 and mounting holes 90 for receiving the fasteners 82, such as depicted in FIG. 5.

Figure 6:
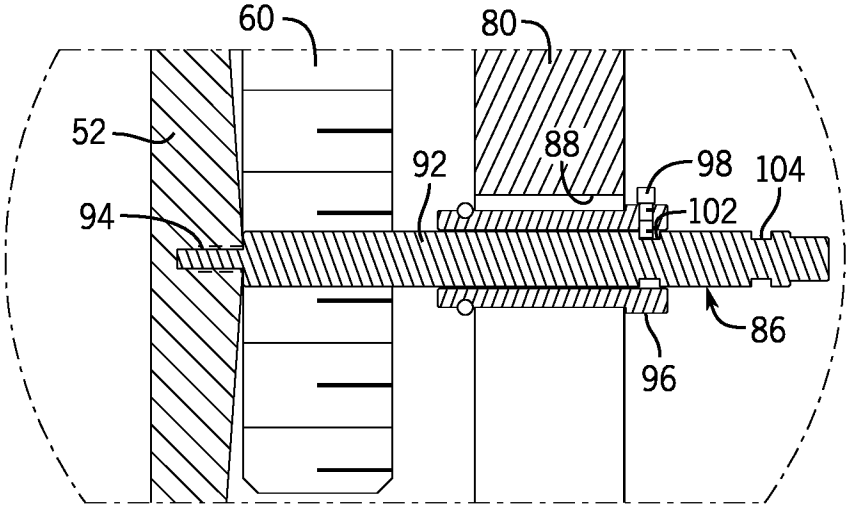
FIG. 6 depicts a retaining screw of the segment retainer holding a compression segment in a radially retracted position in accordance with one embodiment.
Figure 7:
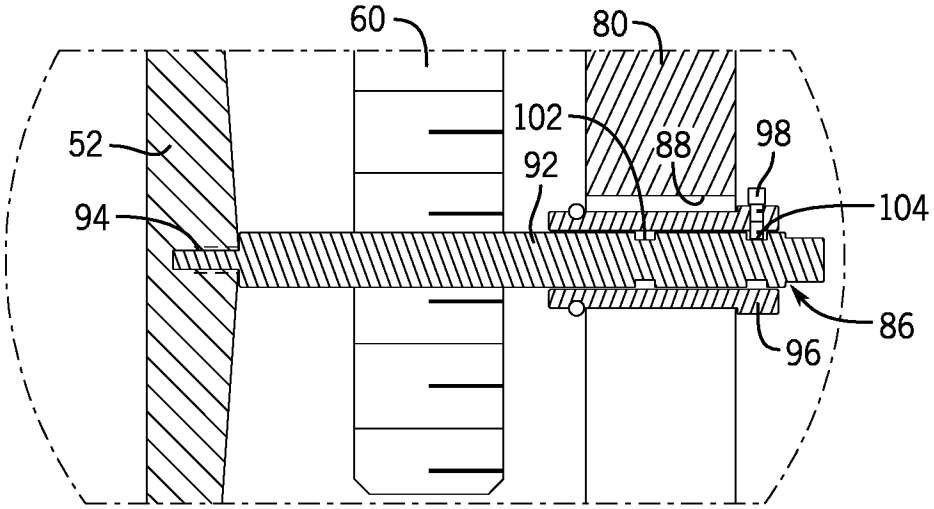
FIG. 7 depicts the retaining screw of FIG. 6 holding the compression segment in a radially extended position in accordance with one embodiment.

FIG. 4 shows the leftmost compression segment 52 in a radially retracted position (which may also be referred to as an "out" position), such as in FIG. 3, to facilitate running of the clamp 50 onto the wellhead housing 20. In contrast, the rightmost compression segment 52 is shown in FIG. 4 in a radially extended position (which may also be referred to as an "in" position) in which the compression segment 52 protrudes radially inward beyond the innermost edges of the energizing rings 54 and 56. Each compression segment 52 can be moved between these in and out positions using a connected retainer screw 86. In one embodiment depicted in FIGS. 6 and 7, for instance, the retainer screw 86 includes an elongate body 92 (e.g., a pin) having an end 94 threaded into a compression segment 52. The body 92 is carried by a sleeve 96 received in the slot 88 of the segment retainer 80. The body 92 may be pulled outward to move the connected compression segment 52 to the out position shown in FIG. 6. In a similar fashion, the screw body 92 may be pushed inward to push the connected compression segment 52 to the in position shown in FIG. 7. A set screw 98 in the sleeve 96 may be inserted into a groove 102 on the screw body 92 to hold the connected compression segment 52 in the out position or into a groove 104 on the screw body 92 to hold the connected compression segment 52 in the in position. In at least some instances, preparing the clamp 50 for running onto the wellhead housing 20 includes installing the segment retainers 80 on the energizing rings 54 and 56, connecting each compression segment 52 to a segment retainer 80 with a retainer screw 86, pulling the screw body 92 of each retainer screw 86 outward until the connected compression segment 52 contacts a stud 60 of the clamp 50, and securing the compression segments 52 in the out positions (e.g., as in FIG. 6) with the set screws 98.

Figure 8:
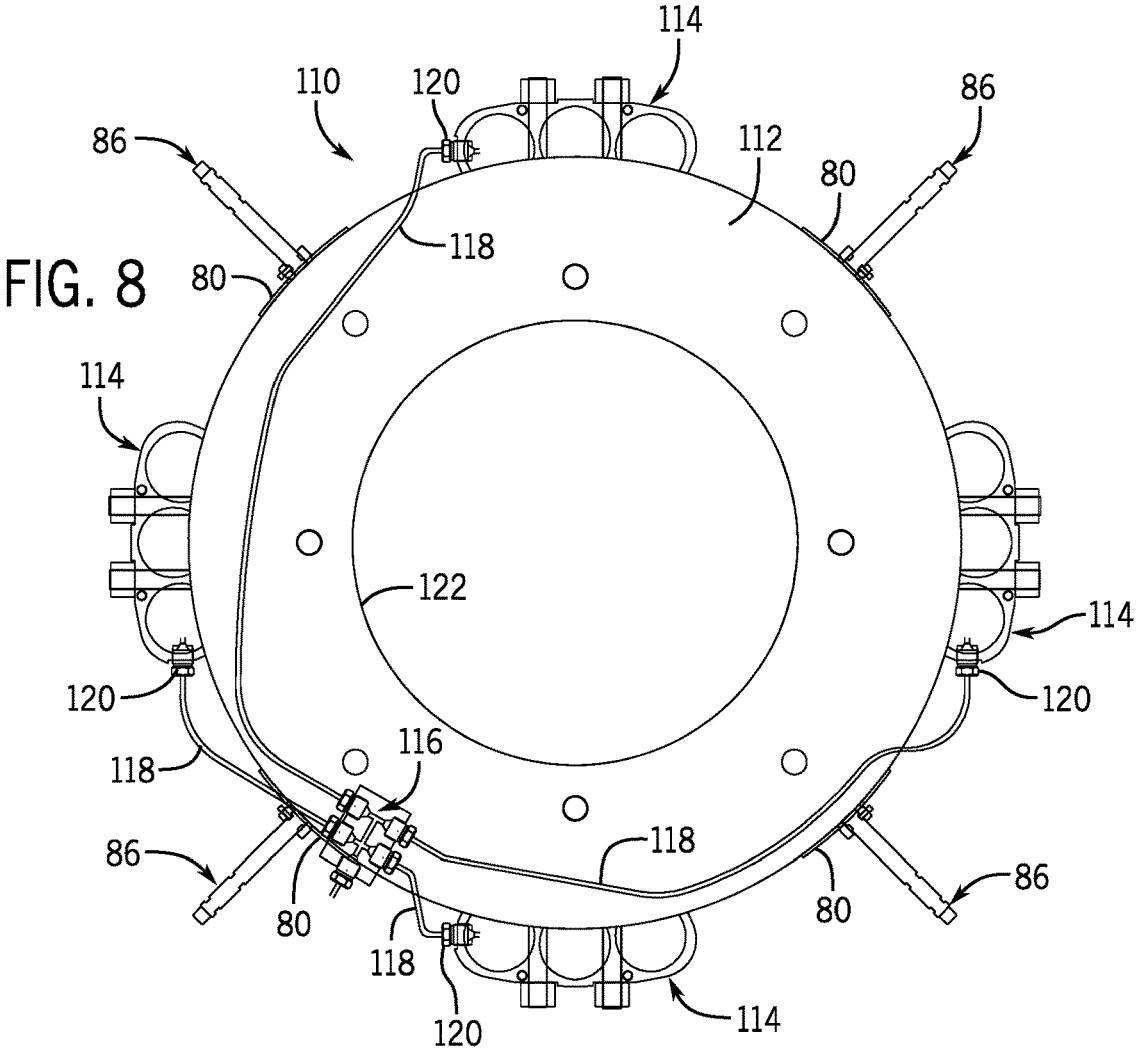
FIG. 8 is a top plan view of a running tool installed on a wellhead clamp in accordance with one embodiment.

A running tool 110 for running the wellhead clamp 50 onto the wellhead housing 20 is depicted in FIG. 8 in accordance with one embodiment. In at least some instances, the running tool 110 is a combination running tool 110 that may also be used to install, set, and retrieve the wellhead clamp 50. The depicted running tool 110 includes a main support body 112 from which hydraulic clamp tools 114 are suspended. Four hydraulic clamp tools 114 are shown in FIG. 8, although some other suitable number of hydraulic clamp tools 114 may be used in other embodiments. The hydraulic clamp tools 114 are shown spaced circumferentially (e.g., at ninety-degree intervals) about the clamp 50, which is largely covered by the body 112 in FIG. 8 but of which four segment retainers 80 and retaining screws 86 may be seen protruding radially outward beyond the support body 112. A hydraulic fluid distribution assembly 116 is also depicted in FIG. 8 and provides hydraulic control fluid received from a single line to the hydraulic clamp tools 114 via hoses 118 and fittings 120 for energizing the clamp 50 via the clamp tools 114. An aperture 122 in the body 112 allows access to the bore 42 of the wellhead housing 20 when the body 112 is positioned over the wellhead housing 20. For instance, a wellhead hanger can be lowered into the bore 42 through the aperture 122 while the running tool 110 is connected to the clamp 50 on the wellhead housing 20.

Figure 9:
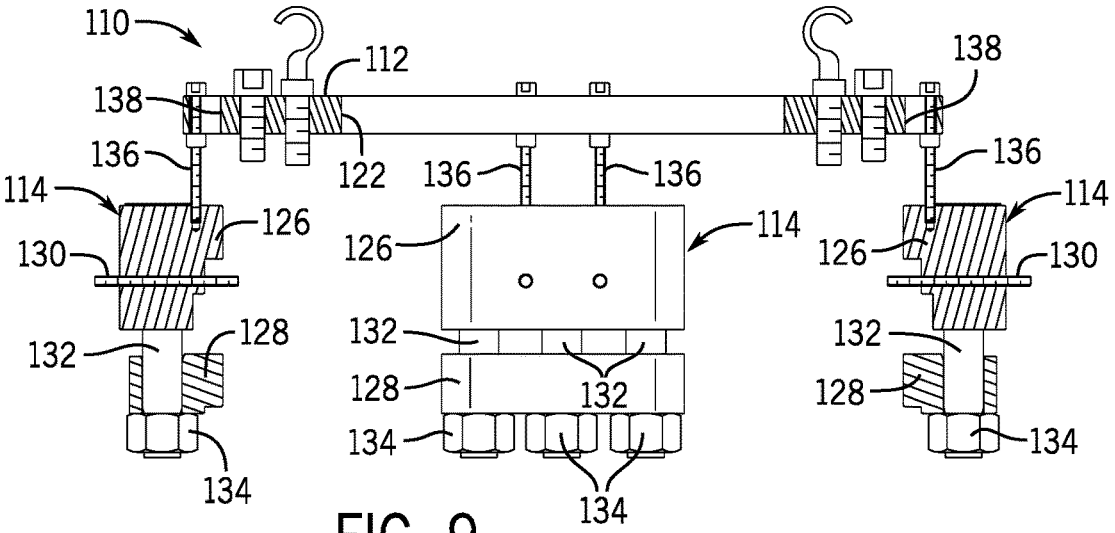
FIG. 9 is a section view of the running tool of FIG. 8 and shows hydraulic clamp tools suspended from a support body via carry rods in accordance with one embodiment.

In the embodiment depicted in FIGS. 8 and 9, each hydraulic clamp tool 114 includes an upper body 126 to engage the energizing ring 56, a lower body 128 to engage the energizing ring 54, and pistons 132 extending between the upper and lower bodies 126 and 128, retained by a nut 134, which may also be referred to as housings. It will be appreciated that hydraulic control fluid can be pumped into each hydraulic clamp tool 114 to control movement of the pistons 132 (e.g., to draw the lower body 128 toward the upper body 126). In the embodiment of FIGS. 8 and 9, each hydraulic clamp tool 114 includes three pistons 132 that act in parallel to move the lower body 128 with respect to the upper body 126. But any other suitable number of pistons 132 may be used in a hydraulic clamp tool 114. In at least some embodiments, a hydraulic clamp tool 114 receives hydraulic control fluid via a single inlet port (e.g., at fitting 120) and distributes that hydraulic control fluid internally to each of the pistons 132.

As also shown in FIG. 9, studs 130 may extend radially through the upper bodies 126 to fasten the hydraulic clamp tools 114 to the energizing ring 56. The hydraulic clamp tools 114 are shown connected to the support 112 with carry rods 136 (which may be carry bolts, in some instances) received through slots 138 in the support 112. The slots 138 allow radial movement of the hydraulic clamp tools 114 toward or away from a clamp 50 surrounded by the tools 114 by moving the carry rods 136 radially inward or outward along the slots 138. This facilitates engagement and disengagement of the hydraulic clamp tools 114 with the energizing rings 54 and 56.

In another embodiment of the running tool 110 generally depicted in FIG. 10, the hydraulic clamp tools 114 are instead connected to the support 112 via braces 142 and fasteners 144. In a further embodiment generally depicted in FIG. 11, the running tool 110 has a split design in which the support 112 has two segments 148 and 150 connected with latches 152. In other embodiments, the support 112 may have more than two segments connected together. Additionally, while the running tool 110 is described above as having clamp tools 114 that are hydraulically actuated, in other instances the clamp tools 114 may be actuated in some other manner (e.g., with mechanical or electrical actuators).

An example sequence for setting the gripping device (clamp) components, energizing the gripping device 50, and locking the components in position via the combination running tool 110 is generally depicted in FIGS. 12-21 and described below. In some cases, use of the combination running tool 110 for delivery and actuation of the gripping device 50 in a single trip may reduce operation time by 75% compared to some other approaches.

Figure 15:
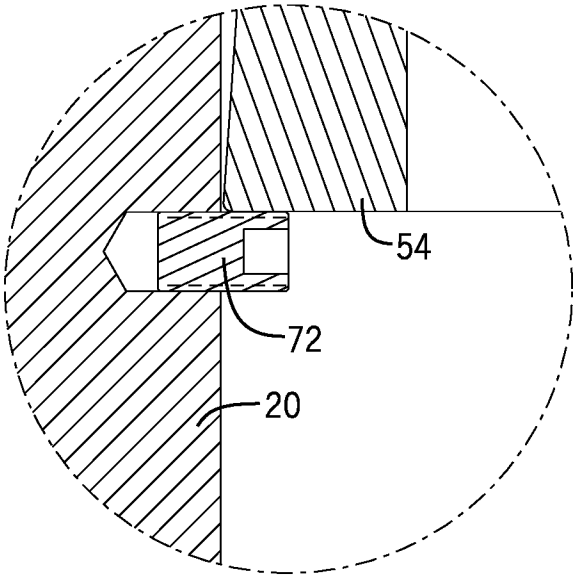
FIG. 15 is a detail view of a lower landing screw of FIG. 14 in accordance with one embodiment.
Figure 12:
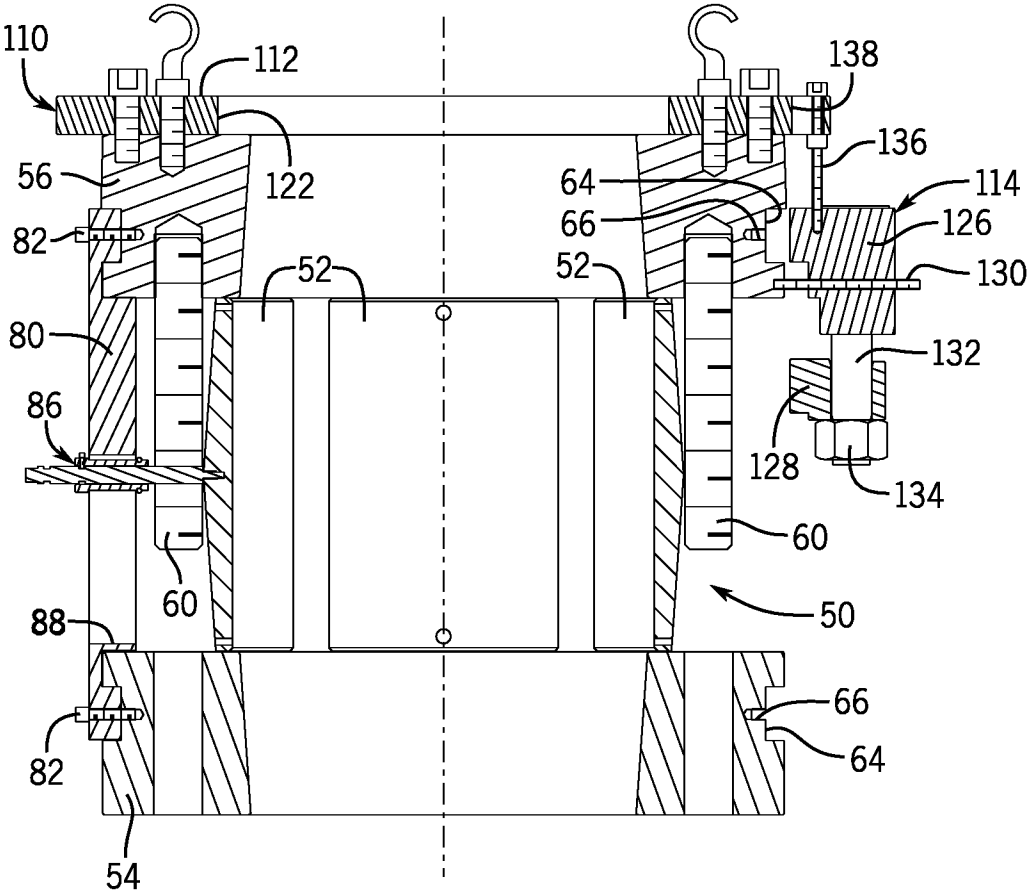
FIG. 12 is a section view of the wellhead clamp of FIGS. 3 and 4 in a running position for lowering onto a wellhead housing in accordance with one embodiment.
Figure 14:
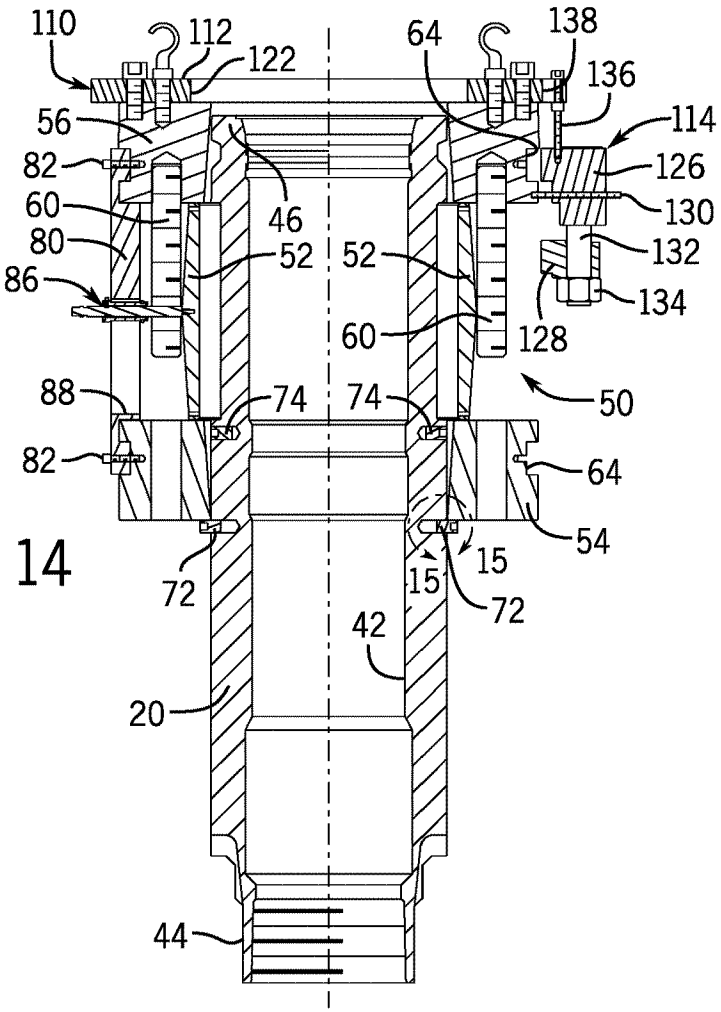
FIG. 14 depicts the wellhead clamp landed on lower landing screws protruding from the wellhead housing in accordance with one embodiment.
Figure 13:
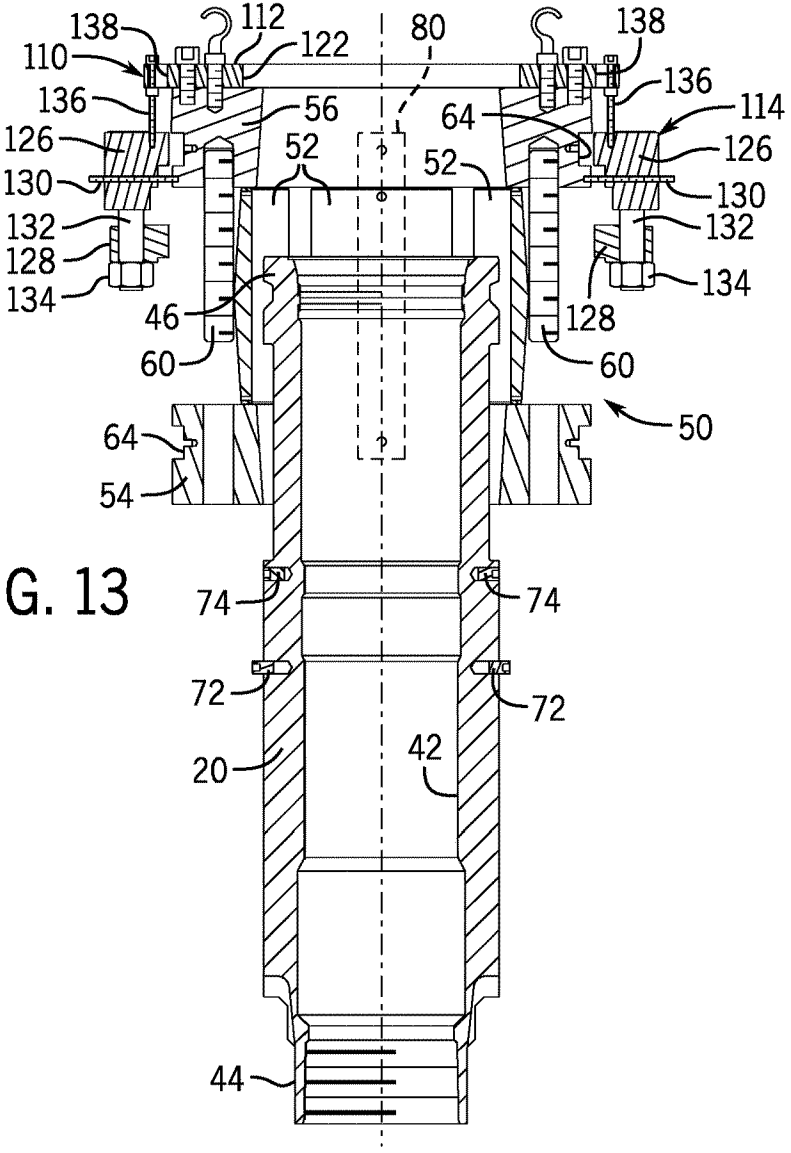
FIG. 13 generally depicts the wellhead clamp being lowered onto the wellhead housing in accordance with one embodiment.

The running tool 110 may be lowered (e.g., via lifting hooks) on and fastened to the clamp 50, such as depicted in FIG. 12. The support 112 of the running tool 110 may be fastened to the clamp 50 with screws, bolts, or any other suitable fasteners. The compression segments 52 are held by segment retainers 80 in the radially retracted position, as discussed above, to facilitate running of the clamp 50 onto the wellhead housing 20 via the running tool 110. In this arrangement, the clamp 50 may be lowered onto the wellhead housing 20 with the running tool 110, such as shown in FIG. 13, and landed on the landing screws 72 protruding from the exterior of the wellhead housing 20, such as shown in FIGS. 14 and 15. The landing screws 72 provide a landing surface for the energizing ring 54, such as shown in FIG. 15. In some embodiments, other protrusions from the exterior of the wellhead housing 20 may also or instead be used as a landing surface for the clamp 50, such as dowel pins inserted into exterior holes in the wellhead housing 20.

Figure 16:
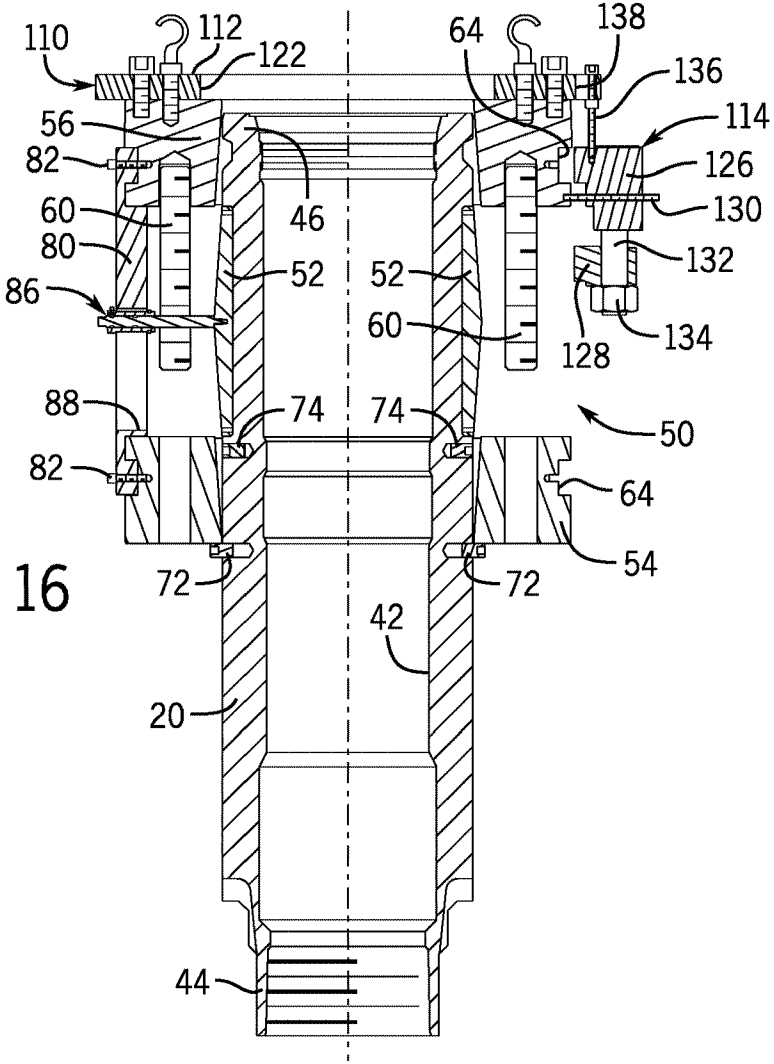
FIG. 16 depicts the compression segments of the wellhead clamp having been moved into contact with the wellhead housing in accordance with one embodiment.

With the wellhead clamp landed on the landing screws 72 (or alternative landing surface), the compression segments 52 are moved inwardly toward the wellhead housing 20 to the positions depicted in FIG. 16. This may include releasing the set screw 98 from the groove 102 of the retaining screw body 92, pushing the compression segments 52 into contact with the exterior of the wellhead housing 20, and resetting the set screw 98 to the groove 104 to retain the compression segments 52 in the "in" position depicted in FIG. 7.

Figure 17:
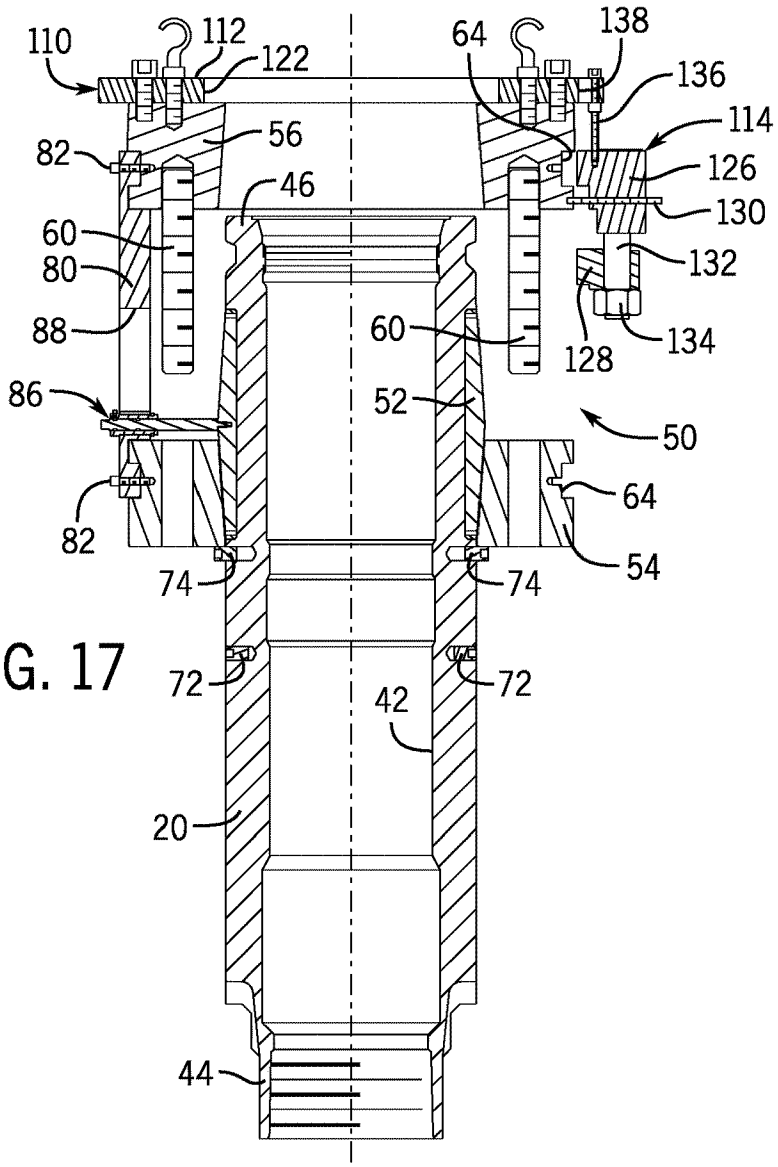
FIG. 17 depicts the energizing rings of the wellhead clamp having been lifted from the position of FIG. 16 and the lower energizing ring landed on upper landing screws protruding from the wellhead housing in accordance with one embodiment.

The running tool 110 may then be raised to lift the energizing rings 54 and 56 relative to the stationary compression segments 52, such as shown in FIG. 17. This generally draws the energizing ring 54 into position encircling the compression segments 52. The slots 88 in the segment retainers 80 allow the retaining screws 86 to remain in place with their connected compression segments 52 while the segment retainers 80 are lifted with the energizing rings 54 and 56. The energizing rings 54 and 56 are lifted to an axial position in which the energizing ring 56 is above the landing screws 74, which may then be backed out to protrude outwardly (e.g., by 0.5 inches, or 1.3 cm) from the exterior of the wellhead housing 20 to provide another landing surface for the clamp 50. As with the landing screws 72, other pins or protrusions may be used with or instead of the landing screws 74. The clamp 50 may then be landed on the landing screws 74, as depicted in FIG. 17.

Figure 19:
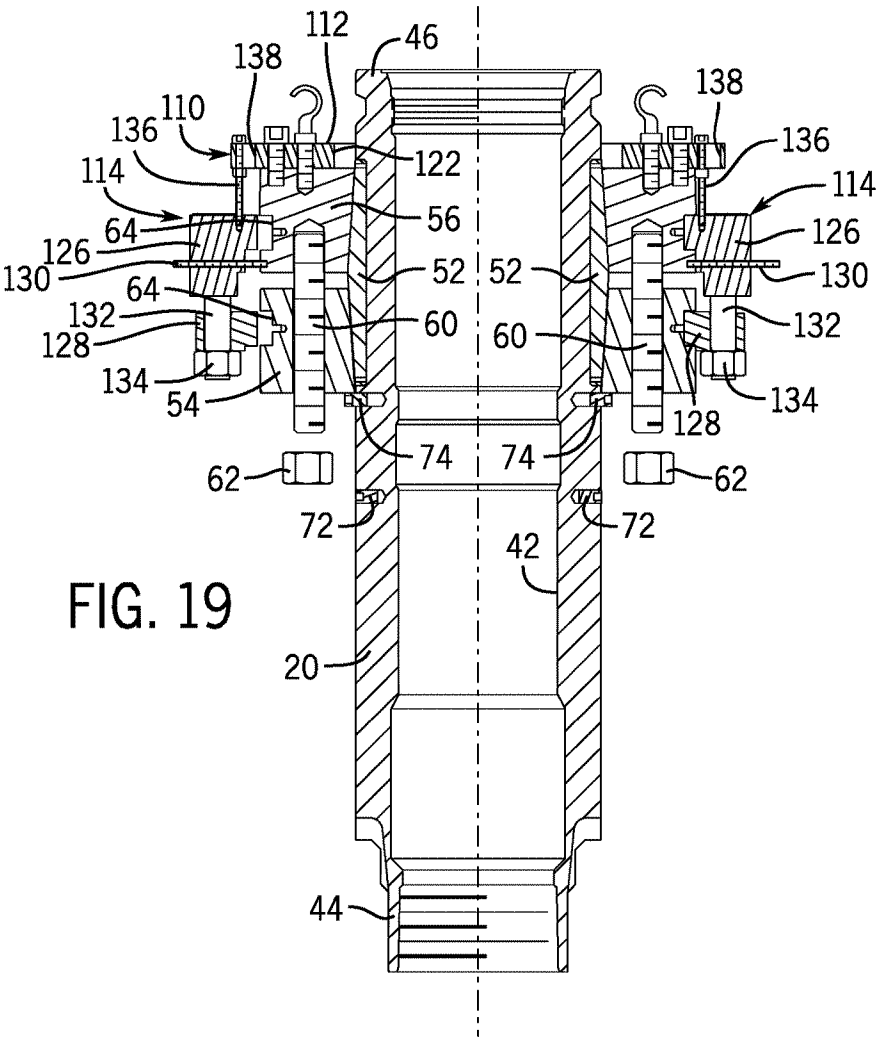
FIG. 19 shows the upper energizing ring lowered from its position in FIG. 18 toward the lower energizing ring in accordance with one embodiment.
Figure 18:
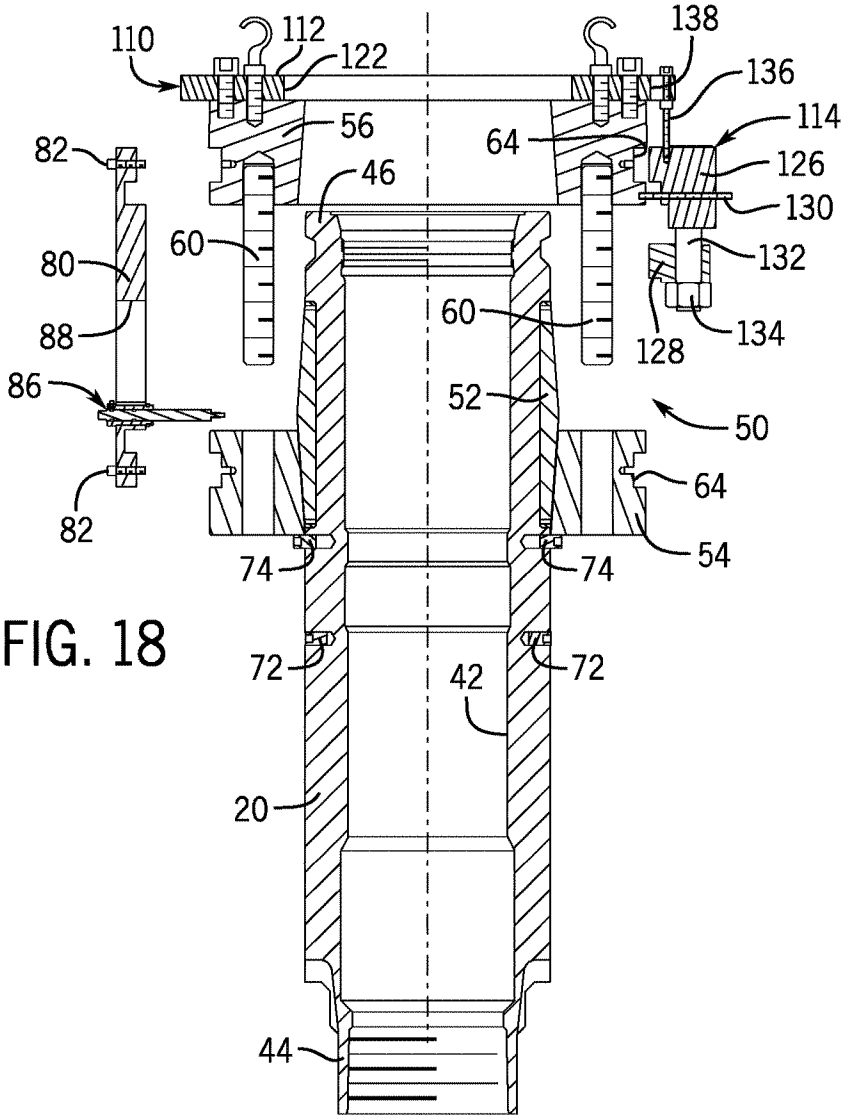
FIG. 18 generally depicts disconnection and removal of the segment retainers from the wellhead clamp in accordance with one embodiment.

The retaining screws 86 may then be disconnected from the compression segments 52, and the segment retainers 80 may be unfastened from the energizing rings 54 and 56, as generally represented in FIG. 18. This allows the energizing ring 56 to then be lowered (relative to the energizing ring 54 and to the compression segments 52) and landed on the mating tapered surfaces of the compression segments 52, as depicted in FIG. 19. In this embodiment, lowering the energizing ring 56 in this manner includes lowering the studs 60 extending from the energizing ring 56 through mating holes of the energizing ring 54. Nuts 62 may then be threaded onto the studs 60.

Figure 21:
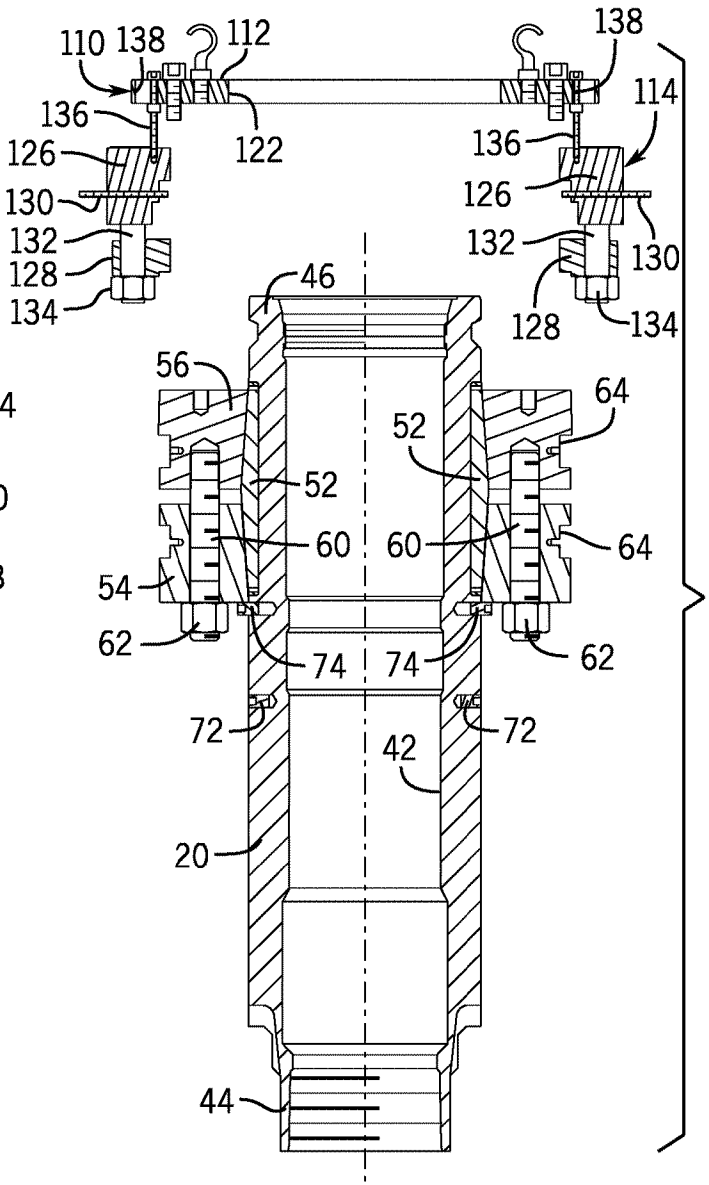
FIG. 21 generally depicts disconnection and removal of the hydraulic clamp tools from the wellhead clamp after setting in accordance with one embodiment.
Figure 20:
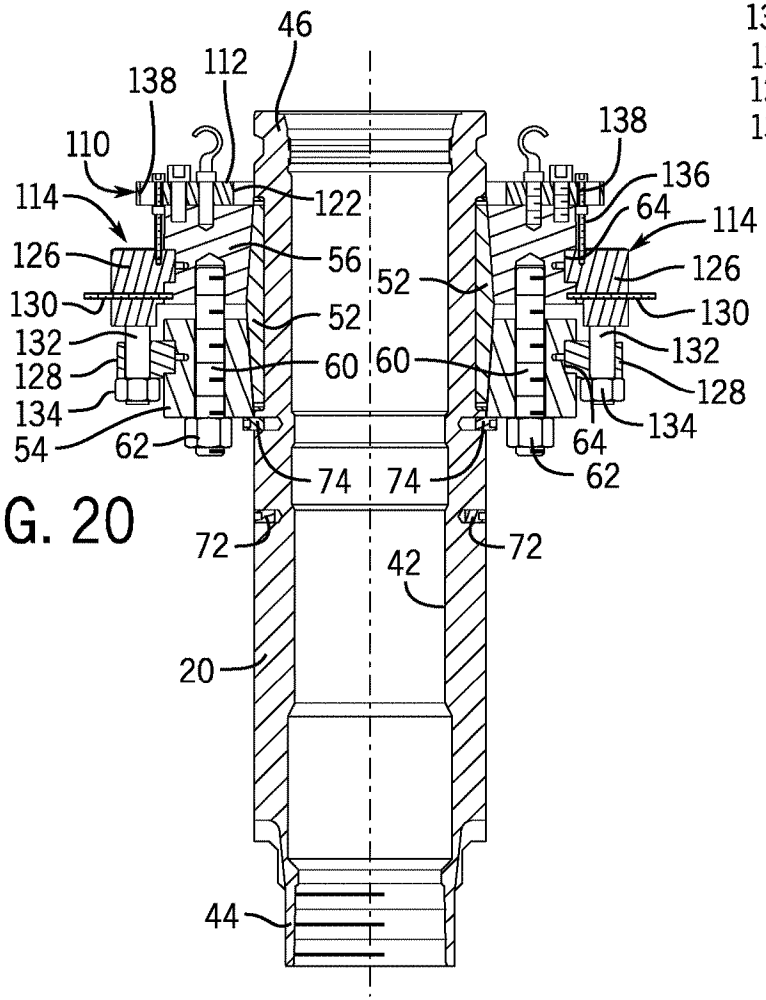
FIG. 20 shows hydraulic clamp tools connected to the energizing rings to apply a setting load to the wellhead clamp in accordance with one embodiment.

After landing the energizing ring 56 on the compression segments 52, the hydraulic clamp tools 114 may then be moved radially inward to engage the energizing rings 54 and 56. As shown in FIG. 20, for instance, a portion of the upper body 126 is inserted into the groove 64 of the energizing ring 56 and a portion of the lower body 128 is inserted into the groove 64 of the energizing ring 54. The carry rods 136 may travel inward along the slots 138 in the support 112 as the hydraulic clamp tools 114 are moved into engagement with the energizing rings 54 and 56. In some instances, a nut on a carry rod 136 may be tightened against the support 112 to resist radial movement of the carry rod 136 and connected hydraulic clamp tool 114. In such instances, the nut on the carry rod 136 may be loosened to facilitate radial movement of the hydraulic clamp tool 114 into or out of engagement with the energizing rings 54 and 56. The wellhead clamp 50 may then be actuated by pressurizing the hydraulic clamp tools 114 to provide the make-up force to the clamp 50 to deform the wellhead housing 20 to securely grip a wellhead hanger positioned within the bore 42. The nuts 62 may be tightened on the studs 60 to maintain the clamp 50 in an energized state. The hydraulic clamp tools 114 and support 112 may then be disconnected from the clamp 50 and lifted away from the wellhead housing 20, such as generally depicted in FIG. 21.

Figure 23:
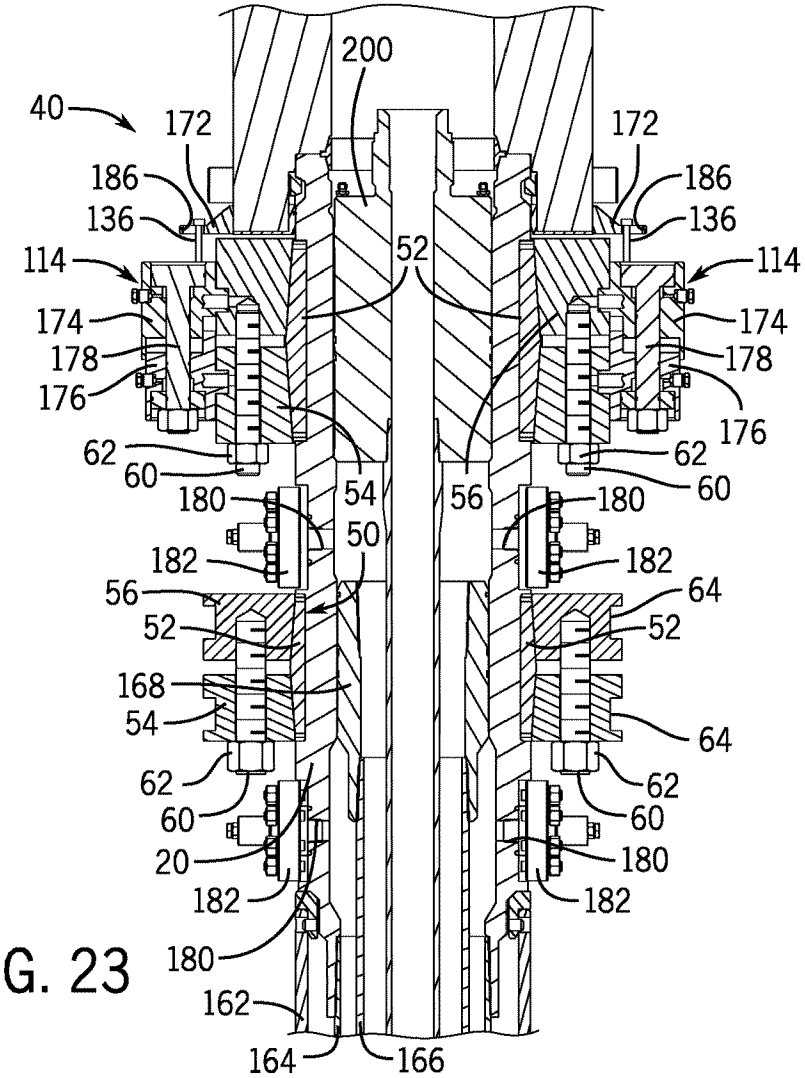
FIGS. 22 and 23 depict a wellhead assembly having two wellhead clamps and hydraulic clamp tools for setting the wellhead clamps in accordance with one embodiment.
Figure 22:
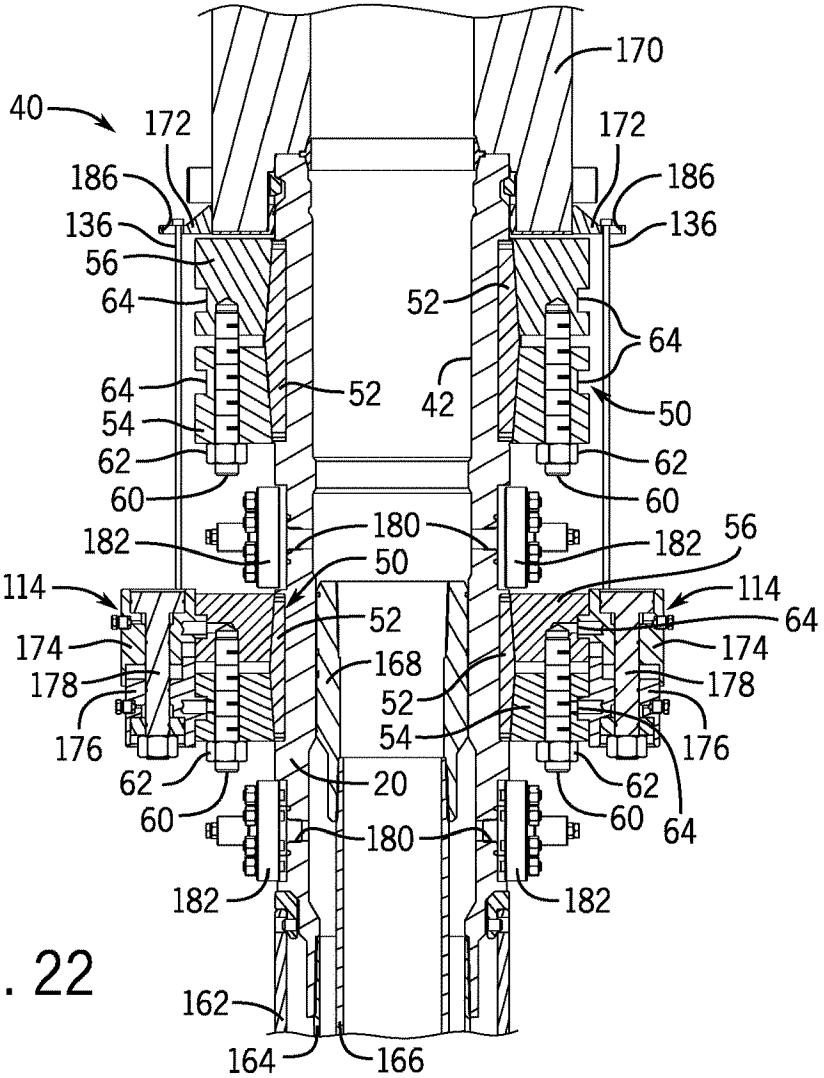

In certain embodiments the hydraulic clamp tools 114 are provided with bidirectional pistons that may be actuated to apply upward and downward setting load to the wellhead clamp 50. In some cases, use of these pistons in the hydraulic clamp tools 114 may provide increased load force, decreased weight, and decreased operational time for setting the clamp 50. An example of such hydraulic clamp tools 114 with bidirectional pistons is depicted in FIGS. 22 and 23. As depicted in these two figures, the wellhead assembly 40 includes a wellhead housing 20 with casing strings 162, 164, and 166 extending downwardly from the wellhead housing 20 into a well. A blowout preventer may be connected to the upper end of the wellhead housing 20 via a blowout preventer adapter 170. Upper and lower clamps 50 are installed on the exterior of the wellhead housing 20. The lower clamp 50 may be actuated to elastically deform the wellhead housing 20 to securely grip a casing hanger 168 (shown connected to casing string 166 in FIGS. 22 and 23) within the bore 42 of the wellhead housing 20. Similarly, as shown in FIG. 23, the upper clamp 50 may be actuated to elastically deform the wellhead housing 20 to securely grip a tubing hanger 200 connected to a tubing string in the bore 42.

The depicted hydraulic clamp tools 114 are connected to a support 172 via carry rods 136 and each includes an upper body 174 to engage the energizing ring 56, a lower body 176 to engage the energizing ring 54, and pistons 178 extending between the upper and lower bodies 174 and 176. The hydraulic clamp tools 114 may be positioned as shown in FIG. 22 to apply a setting load to the lower clamp 50 and may be positioned as shown in FIG. 23 to apply a setting load to the upper clamp 50. Any suitable number of hydraulic clamp tools 114 (e.g., four hydraulic clamp tools) may be arranged circumferentially about the wellhead clamp 50 and used to apply the setting load.

As also shown in FIGS. 22 and 23, the wellhead housing 20 can include ports 180 extending from the bore 42 through the side of the housing 20. Blind flanges 182 can be installed to block flow through the ports 180. In other instances, valves 192 (FIG. 25) may be connected to the wellhead housing 20 in place of blind flanges 182 for controlling flow through the ports 180. But when such valves 192 are installed at ports 180 above the lower clamp 50 in FIGS. 22 and 23, the valves 192 may protrude radially outward from the wellhead housing 20 and obstruct axial movement of the hydraulic clamp tools 114 from the axial position shown in FIG. 23 to the axial position shown in FIG. 22.

Figure 24:
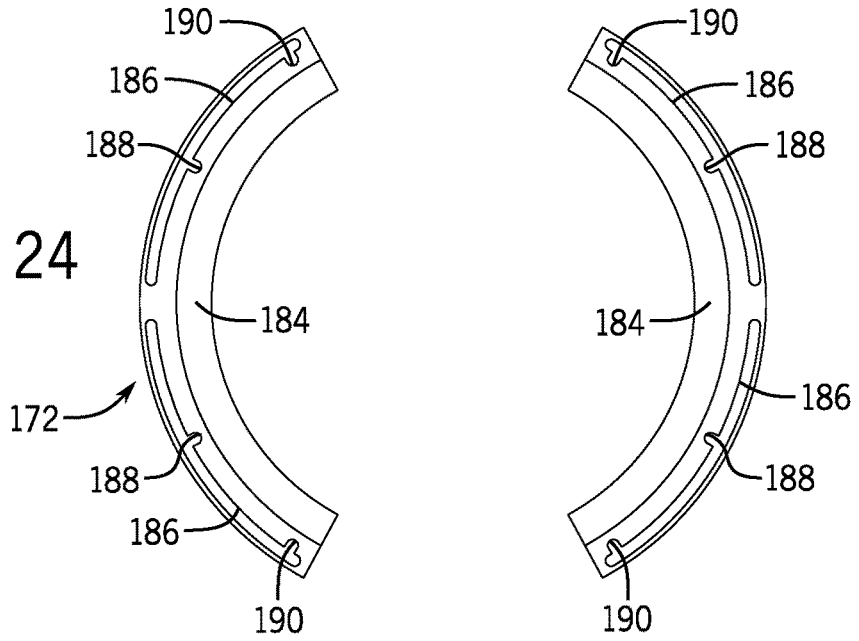
FIG. 24 is a top plan view of a support for carrying the hydraulic clamp tools, with the support having arcuate slots to allow circumferential repositioning of the hydraulic clamp tools, in accordance with one embodiment.

In some embodiments, the support 172 and carry rods 136 allow the hydraulic clamp tools 114 to be moved between different circumferential positions to facilitate lowering of the hydraulic clamp tools 114 along the wellhead housing 20 past the valves 192 or some other obstruction. In FIG. 24, for example, the support 172 is shown as bracket segments 184 with slots 186. The hydraulic clamp tools 114 are suspended from the bracket segments 184 on carry rods 136 installed in the slots 186, which are shown as arcuate slots in FIG. 24. The slots 186 allow the carry rods 136 to travel along the slots 186 to change the horizontal position of the hydraulic clamp tools 114. In the case of arcuate slots 186, a carry rod 136 can be moved along a curved path with the slot 186 to move the hydraulic clamp tool 114 connected to the carry rod 136 from one circumferential position to another. Notches 188 and 190 extend radially inward from the arcuate slots 186 to facilitate radially inward movement of the carry rods 136 (e.g., when fastening the hydraulic clamp tools 114 to a wellhead clamp 50). In some embodiments, each hydraulic clamp tool 114 is suspended from the support 172 by two carry rods 136, which are received in notches 188 and 190 when the hydraulic clamp tool 114 is moved into engagement with a clamp 50.

Figure 25:
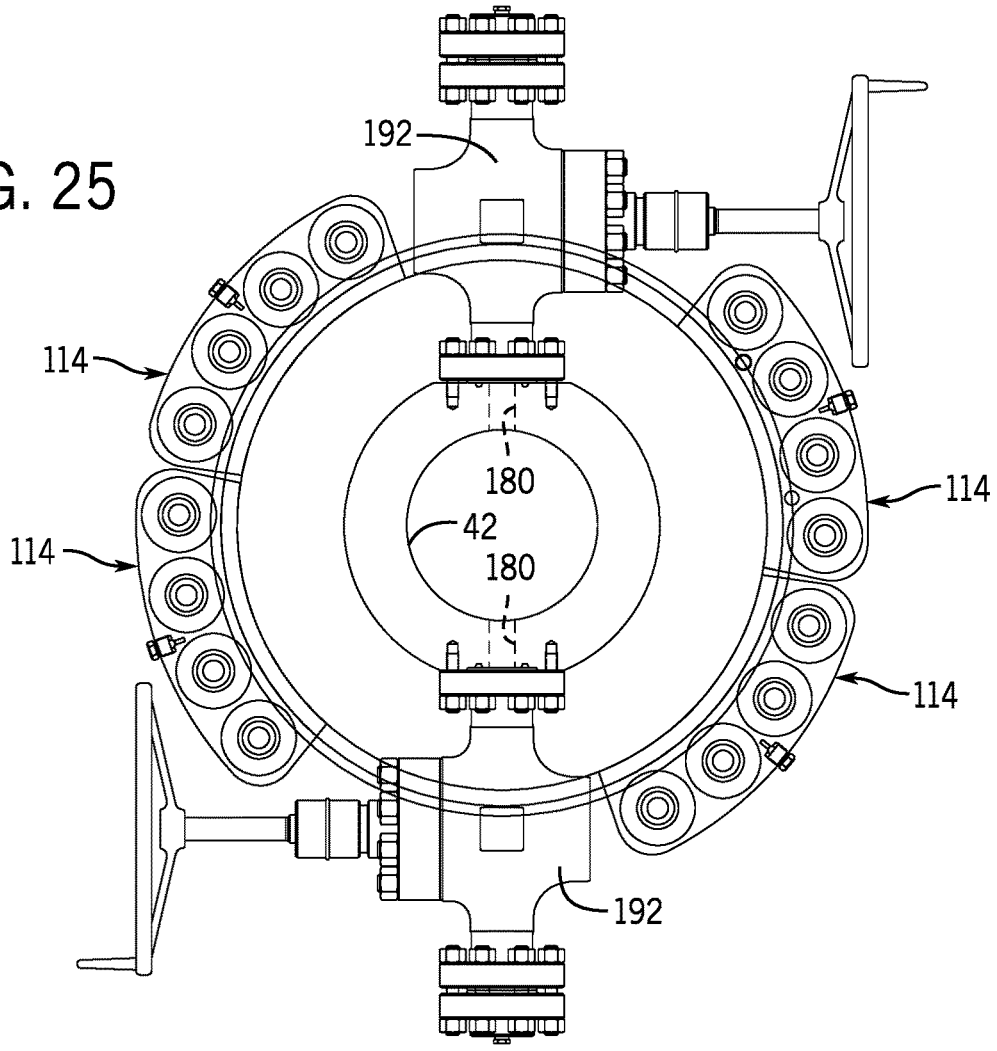
FIG. 25 generally depicts positioning of the hydraulic clamp tools to allow the hydraulic clamp tools to be raised or lowered past valves protruding from the wellhead housing in accordance with one embodiment.

The hydraulic clamp tools 114 may be positioned in one circumferential arrangement to allow the hydraulic clamp tools 114 to be lowered or raised past the valves 192 (or some other obstruction). Once past the valves 192, one or more of the hydraulic clamp tools 114 may be repositioned. In FIG. 25, for instance, two hydraulic clamp tools 114 are positioned alongside one another to the left of the valves 192 and two hydraulic clamp tools 114 are positioned alongside one another to the right of the valves 192. In these positions, the hydraulic clamp tools 114 may be lowered or raised along the wellhead housing 20 past the valves 192. In one embodiment, the support 172 is installed on a blowout preventer stack including the adapter 170, the hydraulic clamp tools 114 are attached to the support 172 with carry rods 136 and arranged as shown in FIG. 25, and the blowout preventer stack is lowered and rotated such that the hydraulic clamp tools 114 straddle the valves 192 as shown in FIG. 25. Once the hydraulic clamp tools 114 have been lowered beyond the valves 192 (e.g., to the lower clamp 50 of FIG. 22), the hydraulic clamp tools 114 may be spread apart (e.g., to be evenly spaced circumferentially about the clamp 50) and then pushed into engagement with the clamp 50 (such as shown in FIG. 22).

Figure 26:
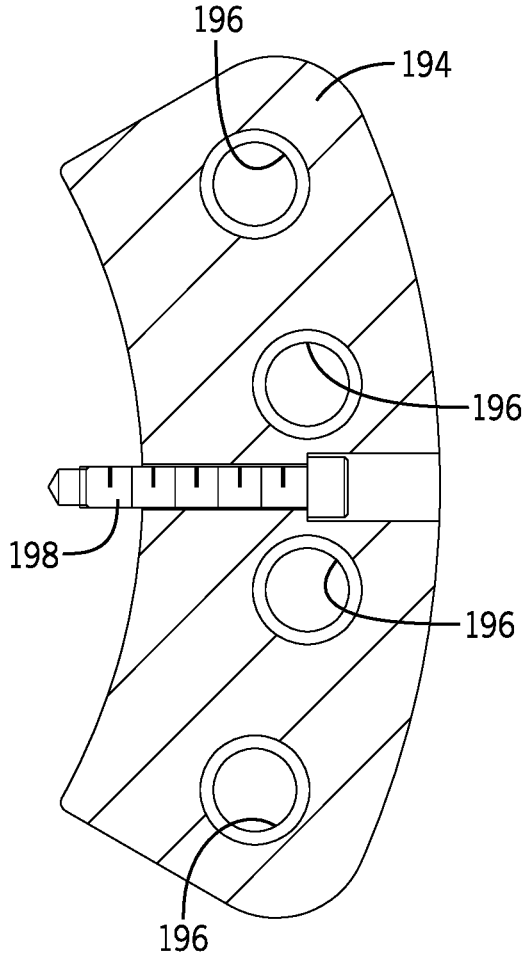
FIG. 26 is a section view of a body of the hydraulic clamp tool with a bolt for securing the body to an energizing ring of the wellhead clamp in accordance with one embodiment.

In some embodiments, the upper and lower bodies 174 and 176 of the hydraulic clamp tools 114 are secured to a clamp 50 with bolts or other fasteners. In FIG. 26, for example, the upper and lower bodies 174 and 176 may be provided as an arcuate body 194 having bores 196 (for pistons 178) and a bolt 198 that may be threaded into a mating hole in the energizing ring 54 or 56 to secure the hydraulic clamp tool 114 to the clamp 50. Although the body 194 is shown as having bores 196 for four pistons 178, each of the hydraulic clamp tools 114 may have any other suitable number of pistons 178 in other embodiments.

Figure 27:
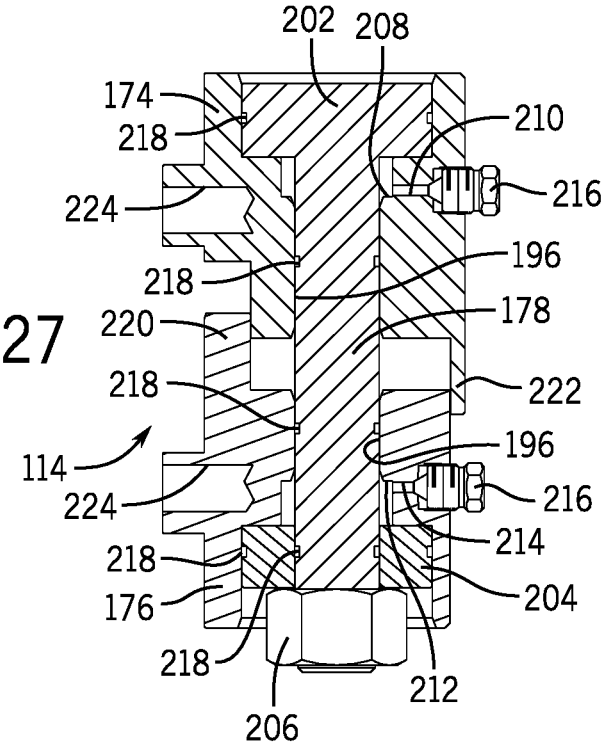
FIG. 27 is a section view of a bidirectional piston of the hydraulic clamp tool for applying a setting load to the wellhead clamp in accordance with one embodiment.

As noted above, the hydraulic clamp tools 114 include bidirectional pistons 178 in some embodiments. As shown in greater detail in FIG. 27, for instance, the piston 178 includes a piston head 202 positioned in the upper body 174 and a piston head 204 positioned in the lower body 176. To facilitate installation, the piston head 204 of FIG. 27 is a piston ring that is positioned along a shaft of the piston 178 and retained by a nut 206. Hydraulic control fluid may be pumped into a cavity 208 through a port 210 (e.g., via a fitting 216) to pressurize the cavity 208 and apply an upward load on the piston head 202 and a downward load on the upper body 174. Hydraulic control fluid may also or instead be pumped into a cavity 212 through a port 214 (e.g., via another fitting 216) to pressurize the cavity 212 and apply a downward load on the piston head 204 and an upward load on the lower body 176. Various seals 218 isolate the working cavities 208 and 212 and prevent leaks. Axially protruding portions 220 and 222 prevent bending during actuation of the piston 178. The upper and lower bodies 174 and 176 can include radial bores 224, portions of which are shown in FIG. 27, for receiving bolts 198 for fastening the bodies 174 and 176 to a clamp 50.

Figure 28:
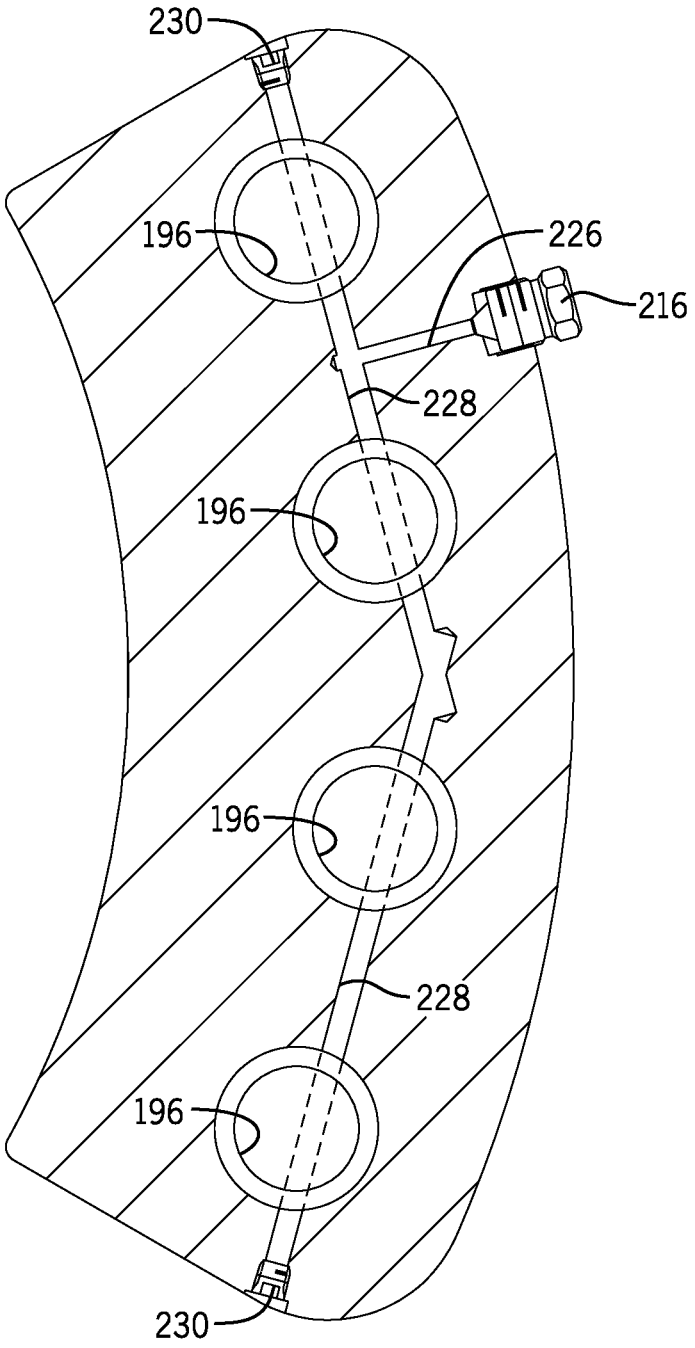
FIG. 28 is a section view of a body of the hydraulic clamp tool generally showing a control fluid path within the body in accordance with one embodiment.

Hydraulic control fluid may be routed to the working cavities 208 and 212 in any suitable manner. In one embodiment generally depicted in FIG. 28, control fluid is routed into the tool body through a single inlet 226 and distributed to working cavities 208 or 212 in the tool body through bores 228. As generally shown in FIG. 28, such bores 228 may be formed by drilling into the body across the piston bores 196, and the bores 228 may be sealed at their ends with plugs 230.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a wellhead clamp configured to elastically deform a wellhead housing to securely grip a wellhead hanger positioned within a bore of the wellhead housing, the wellhead clamp including:

a first energizing ring;

a second energizing ring;

compression segments positioned between the first energizing ring and the second energizing ring; and segment retainers fastened to the compression segments so as to retain the compression segments between the first energizing ring and the second energizing ring, wherein the segment retainers are also connected to the first energizing ring and to the second energizing ring to hold the first energizing ring and the second energizing ring apart in an expanded arrangement that allows the compression segments to be in a radially retracted position that facilitates running of the wellhead clamp onto the wellhead housing.

2. The apparatus of claim 1, comprising a running tool for running the wellhead clamp onto the wellhead housing.

3. The apparatus of claim 2, wherein the running tool is configured to actuate the wellhead clamp following disconnection of the segment retainers from the first energizing ring, from the second energizing ring, and from the compression segments.

4. The apparatus of claim 1, comprising a hydraulic clamp tool for actuating the wellhead clamp, the hydraulic clamp tool including an upper body configured to engage the first energizing ring, a lower body configured to engage the second energizing ring, and a piston extending between the upper body and the lower body.

5. The apparatus of claim 4, wherein the piston includes a first piston head disposed within the upper body and a second piston head disposed within the lower body.

6. The apparatus of claim 1, comprising multiple hydraulic clamp tools for actuating the wellhead clamp, each of the multiple hydraulic clamp tools including an upper body configured to engage the first energizing ring, a lower body configured to engage the second energizing ring, and a piston extending between the upper body and the lower body.

7. The apparatus of claim 6, wherein each of the multiple hydraulic clamp tools is connected to a support via a carry rod.

8. The apparatus of claim 7, wherein the multiple hydraulic clamp tools are configured to be spaced circumferentially about the wellhead clamp and the support includes an arcuate slot that enables at least one of the multiple hydraulic clamp tools to be moved between different circumferential positions by moving at least one of the carry rods along a curved path within the arcuate slot.

9. The apparatus of claim 6, wherein the multiple hydraulic clamp tools are fastened to a running tool for running the wellhead clamp onto the wellhead housing.

10. The apparatus of claim 1, comprising the wellhead housing, wherein the wellhead clamp is landed on one or more landing screws protruding from the wellhead housing.

11. An apparatus for actuating a wellhead clamp that includes a first energizing ring, a second energizing ring, and compression segments positioned between the first energizing ring and the second energizing ring, the apparatus comprising:

hydraulic clamp tools having an upper body configured to engage the first energizing ring, a lower body configured to engage the second energizing ring, and a piston extending between the upper body and the lower body; and carry rods connecting the hydraulic clamp tools to a support;

wherein the hydraulic clamp tools are configured to be spaced circumferentially about the wellhead clamp and the support includes an arcuate slot that enables at least one of the hydraulic clamp tools to be moved between different circumferential positions by moving at least one of the carry rods along a curved path within the arcuate slot.

12. The apparatus of claim 11, wherein the piston includes a first piston head disposed within the upper body and a second piston head disposed within the lower body.

13. The apparatus of claim 11, wherein the apparatus includes four hydraulic clamp tools that each have multiple pistons.

14. A method including:

lowering a wellhead clamp onto a wellhead housing, the wellhead clamp including: a first energizing ring; a second energizing ring; and compression segments positioned between the first energizing ring and the second energizing ring, wherein the compression segments are positioned in a radially retracted position that facilitates lowering of the wellhead clamp onto the wellhead housing;

landing the wellhead clamp on a first surface protruding outwardly from an exterior of the wellhead housing;

with the wellhead clamp landed on the first surface protruding outwardly from the exterior of the wellhead housing, moving the compression segments inwardly toward the wellhead housing from the radially retracted position;

after moving the compression segments inwardly toward the wellhead housing from the radially retracted position, lifting the first energizing ring and the second energizing ring relative to the compression segments and then landing the wellhead clamp on a second surface protruding outwardly from the exterior of the wellhead housing; and after landing the wellhead clamp on the second surface protruding outwardly from the exterior of the wellhead housing, lowering the first energizing ring relative to the second energizing ring and to the compression segments.

15. The method of claim 14, wherein lowering the first energizing ring relative to the second energizing ring includes lowering the first energizing ring such that studs extending from the first energizing ring are lowered through mating holes of the second energizing ring.

16. The method of claim 14, wherein landing the wellhead clamp on the first surface protruding outwardly from the exterior of the wellhead housing includes landing the wellhead clamp on a landing screw protruding outwardly from the exterior of the wellhead housing.

17. The method of claim 14, wherein landing the wellhead clamp on a second surface protruding outwardly from the exterior of the wellhead housing includes moving the second surface, after lifting the first energizing ring and the second energizing ring relative to the compression segments, to cause the second surface to protrude outwardly from the exterior of the wellhead housing.

18. The method of claim 14, wherein, during lowering of the wellhead clamp onto the wellhead housing and landing of the wellhead clamp on the first surface protruding outwardly from the exterior of the wellhead housing, segment retainers fastened to the compression segments retain the compression segments between the first energizing ring and the second energizing ring in the radially retracted position and hold the first energizing ring and the second energizing ring apart, and wherein the method includes disconnecting the segment retainers from the first energizing ring, from the second energizing ring, and from the compression segments after landing the wellhead clamp on the second surface protruding outwardly from the exterior of the wellhead housing to enable lowering of the first energizing ring relative to the second energizing ring and to the compression segments.

19. The method of claim 14, comprising actuating the wellhead clamp to elastically deform the wellhead housing to securely grip a wellhead hanger positioned within a bore of the wellhead housing.

20. The method of claim 19, wherein actuating the wellhead clamp to elastically deform the wellhead housing includes actuating the wellhead clamp with a hydraulic clamp tool connected to the first energizing ring and to the second energizing ring.

* * * * *